US008783907B2

(12) United States Patent
Hsiao

(10) Patent No.: US 8,783,907 B2
(45) Date of Patent: Jul. 22, 2014

(54) LAMP SOCKET AND CABLE BRACKET ASSEMBLY

(76) Inventor: Ming Jen Hsiao, Toufen (TW)

( * ) Notice: Subject to any disclaimer, the term of this patent is extended or adjusted under 35 U.S.C. 154(b) by 357 days.

(21) Appl. No.: 13/368,902

(22) Filed: Feb. 8, 2012

(65) Prior Publication Data

US 2013/0201659 A1 Aug. 8, 2013

(51) Int. Cl.
*F21V 33/00* (2006.01)
*H01R 13/58* (2006.01)

(52) U.S. Cl.
CPC ..... *F21V 33/00* (2013.01); *H01R 13/5812* (2013.01)
USPC ..... 362/253; 362/294; 362/370; 362/373; 362/391; 362/432; 362/643

(58) Field of Classification Search
None
See application file for complete search history.

(56) References Cited

U.S. PATENT DOCUMENTS

| | | | | |
|---|---|---|---|---|
| 3,868,500 | A * | 2/1975 | Martin | 362/464 |
| 5,651,942 | A * | 7/1997 | Christensen | 422/125 |
| 7,133,605 | B2 * | 11/2006 | Niemeyer | 392/390 |
| 2011/0110092 | A1 * | 5/2011 | Hsiao | 362/253 |
| 2011/0128747 | A1 * | 6/2011 | Hsiao | 362/432 |

* cited by examiner

*Primary Examiner* — Ashok Patel
(74) *Attorney, Agent, or Firm* — Ming Chow; Sinorica, LLC

(57) ABSTRACT

A lamp socket and cable bracket assembly includes a lamp socket holding a lamp bulb, electrical wires extended from the lamp socket for connection to power source, and a flat cable bracket configured to hold the electrical wires in a smoothly curved manner against stretching and to dissipate heat radiated by the lamp bulb, avoiding electrical wire damage.

18 Claims, 6 Drawing Sheets

LAMP SOCKET AND CABLE BRACKET ASSEMBLY

FIELD OF THE INVENTION

The present invention relates to scent releasing devices and more specifically, to a lamp socket and cable bracket assembly, which is equipped with a flat cable bracket configured to hold electrical wires in a smoothly curved manner against stretching and to dissipate heat radiated by the lamp bulb, avoiding electrical wire damage.

DESCRIPTION OF THE RELATED ART

An electrical wire fixation structure for lamp socket must pass a tensile strength test, avoiding disconnection from the lamp socket upon an external force. In U.S. Ser. Nos. 12/614,189; 12/626,979, a plastic bracket is fastened to the holder base of the lamp socket for holding electrical wires. The plastic bracket comprises a transverse extension lug, a wire hole cut through the transverse extension lug and two wire notches at two sides relative to the transverse extension lug. The electric wires are inserted through the wire hole on the transverse extension lug and turned backwardly apart and then respectively attached to the wire notches for electrically connecting two metal terminals in the holder base to an external power source. After installation, the electrical wires are curved in a large angle. As the electrical wires are heavily curved, the molecules of the insulation of the electrical wires at the curved corners may be damaged when the electrical wires are stretched by an external force. Further, the insulation of the electrical wires at the curved corners will deteriorate in mechanical strength under the effect of the heat energy released by the lamp bulb.

SUMMARY OF THE INVENTION

The present invention has been accomplished under the circumstances in view. It is therefore the main object of the present invention to provide a lamp socket and cable bracket assembly, which holds electrical wires in a smoothly curved manner against stretching and quickly dissipates heat radiated by the lamp bulb, avoiding electrical wire damage.

To achieve this and other objects of the present invention, a lamp socket and cable bracket assembly comprises a lamp socket, electrical wires electrically connected to respective electrodes in the lamp socket for connection to power source, and a high tensile strength cable bracket for securing the electrical wires. The high tensile strength cable bracket is a plate member comprising a mounting lug fixedly connected to the lamp socket, a planar panel, a sloping panel obliquely connected between the mounting lug and the planar panel, a first cable-retaining notch and a second cable-retaining notch respectively and symmetrically located on two opposite lateral sides of the sloping panel, and a third cable-retaining notch and a fourth cable-retaining notch respectively and symmetrically located on two opposite lateral sides of the planar panel.

Further, the first, second, third and fourth cable-retaining notches each define a mouth. The mouth has a width relatively shorter than the internal width of the respective cable-retaining notch.

Further, the first electrical wire is inserted from the bottom side of the sloping panel through the first cable-retaining notch toward the top side of the planar panel, and then extended downwardly through the third cable-retaining notch to the bottom side of the planar panel and then turned forwardly out of the cable bracket to the power source. Further, the second electrical wire is inserted from the bottom side of the sloping panel through the second cable-retaining notch toward the top side of the planar panel, and then extended downwardly through the fourth cable-retaining notch to the bottom side of the planar panel and then turned forwardly out of the high tensile strength cable bracket to the power source.

The lamp socket and cable bracket assembly further comprises a lamp bulb installed in the lamp socket and electrically connected to the electrodes for giving off light and heat energy, and an aroma-diffusion lampshade fastened to the lamp socket around the lamp bulb and configured to hold an aromatic substance in a recessed top side thereof for heating into vapor by the heat energy released by the lamp bulb. Further, the aroma-diffusion lampshade has a cable hole for the passing of the first electrical wire and the second electrical wire.

Further, the cable bracket can transfer heat energy for quick dissipation of heat, maintaining the mechanical strength of the electrical wires.

DETAILED DESCRIPTION OF THE PREFERRED EMBODIMENT

Figure 1:
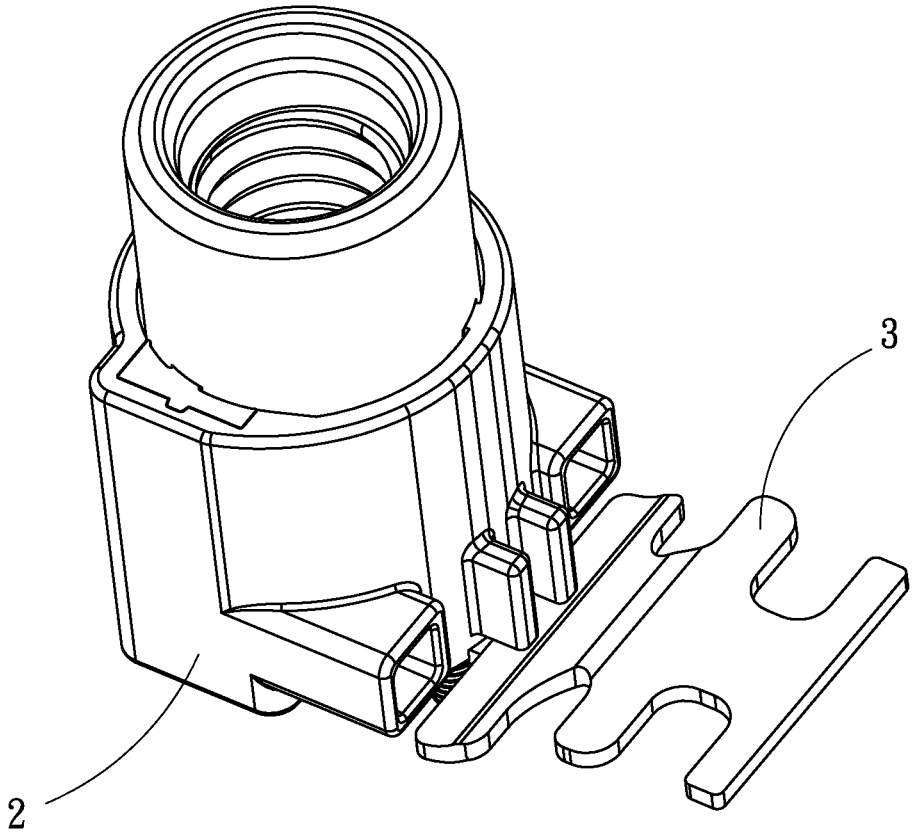
FIG. 1 is an elevational assembly view of a lamp socket and a cable bracket of a lamp socket and cable bracket assembly in accordance with the present invention.
Figure 2:
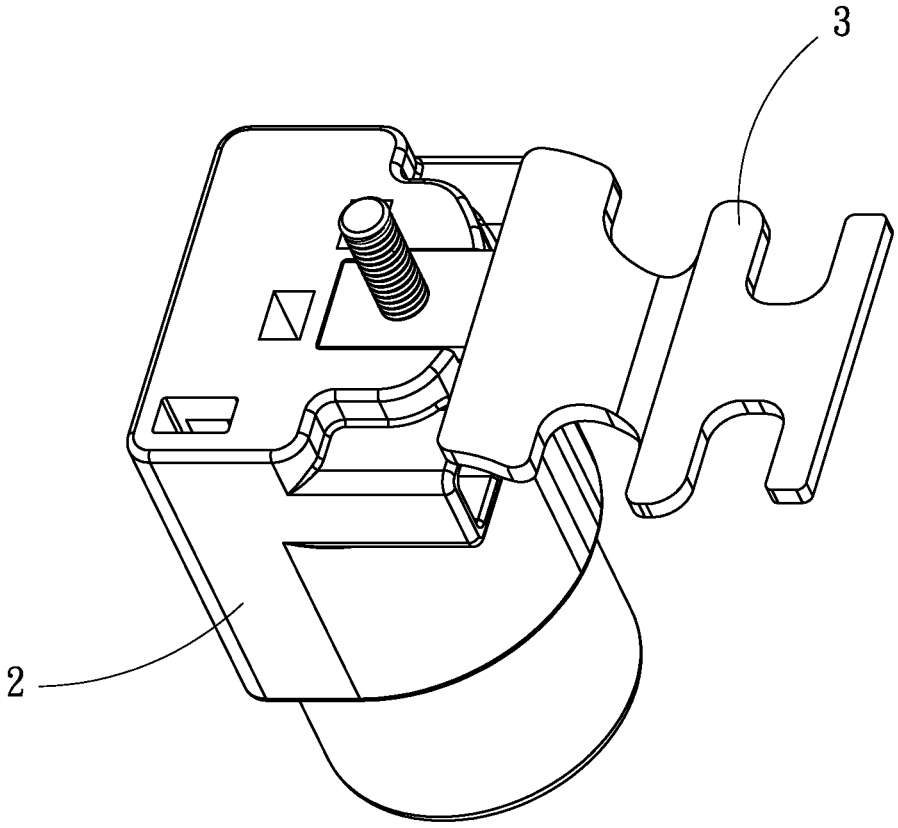
FIG. 2 corresponds to FIG. 1 when viewed from another angle.
Figure 3:
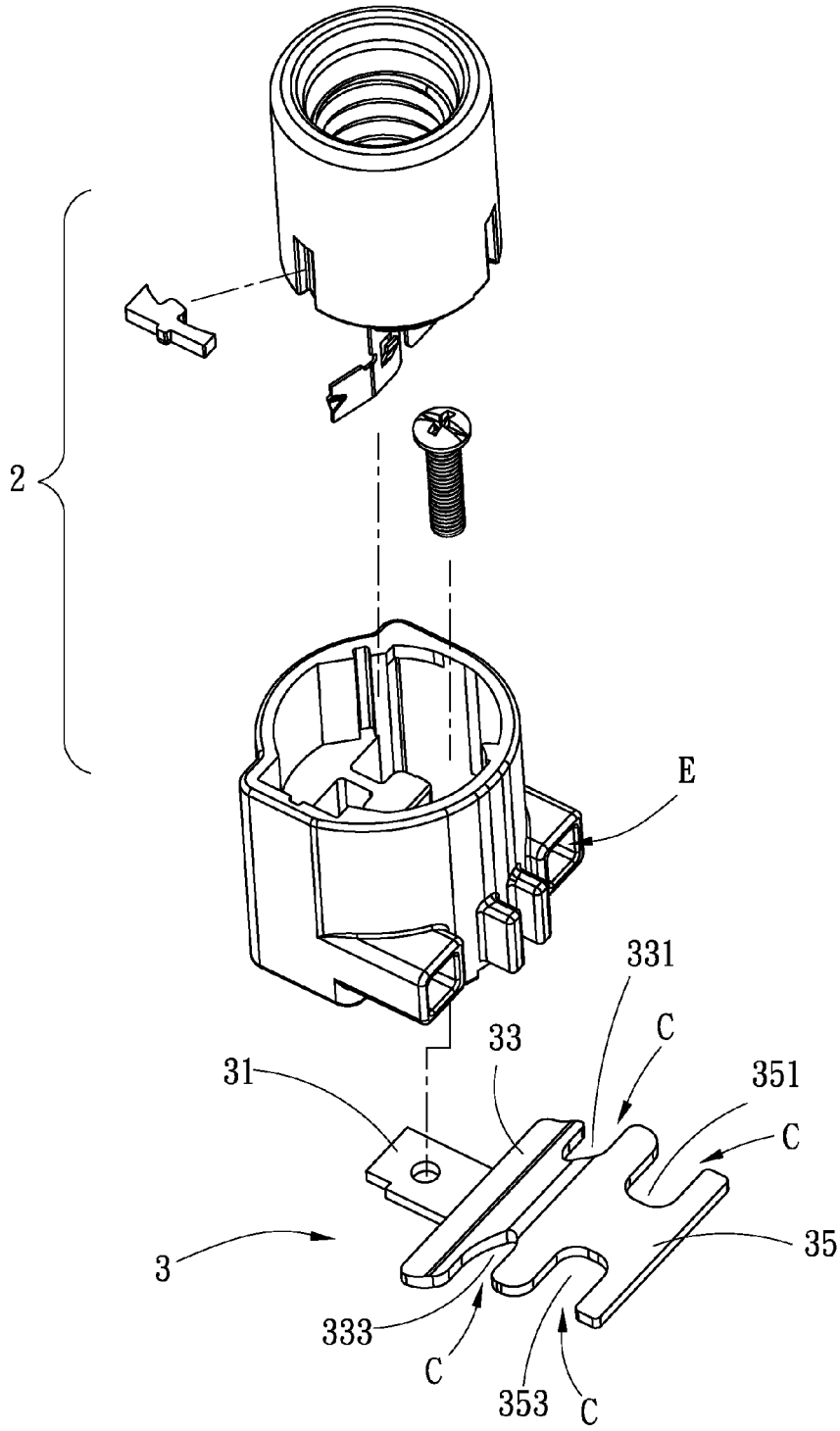
FIG. 3 is an exploded view of the assembly shown in FIG. 1.

Referring to FIGS. 1-3, a lamp socket and cable bracket assembly in accordance with the present invention is shown comprising a lamp socket 2 and a high tensile strength cable bracket 3.

The high tensile strength cable bracket 3 comprises a mounting lug 31 fixedly connected to the lamp socket 2, a planar panel 35, a sloping panel 33 obliquely connected between the mounting lug 31 and the planar panel 35, a first cable-retaining notch 331 and a second cable-retaining notch 333 respectively and symmetrically located on two opposite lateral sides of the sloping panel 33, and a third cable-retaining notch 351 and a fourth cable-retaining notch 353 respectively and symmetrically located on two opposite lateral sides of the planar panel 35.

Each of the cable-retaining notches 331;333;531;533 defines a mouth C. The mouth C has a width relatively shorter than the internal width of the respective cable-retaining notch 331;333;531;533, facilitating quick positioning of electrical wires in the cable-retaining notches 331;333;531;533. Further, through holes can be formed in the sloping panel 33 and the planar panel 35 instead of the cable-retaining notches 331;333;531;533 for securing electrical wires.

Figure 4:
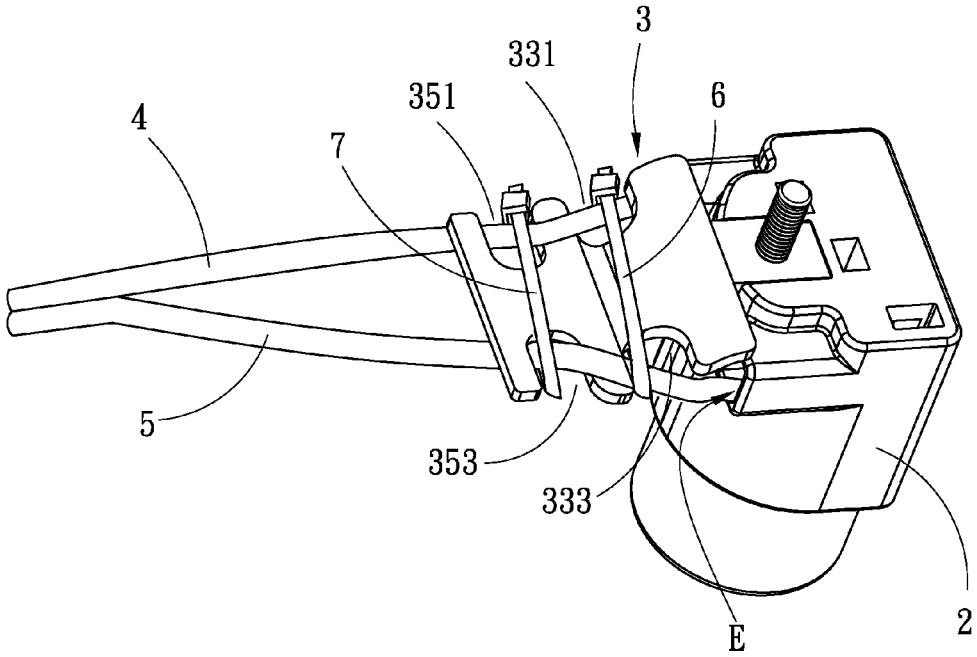
FIG. 4 is an elevational assembly view of the lamp socket and cable bracket of the lamp socket and cable bracket assembly in accordance with the present invention.

Referring to FIG. 4, the lamp socket and cable bracket assembly further comprises a first electrical wire 4 and a second electrical wire 5. The first electrical wire 4 and the second electrical wire 5 are respectively electrically connected to the electrodes E of the lamp socket 2 at right angles.

Further, the first electrical wire 4 is inserted from the bottom side of the sloping panel 33 through the first cable-retaining notch 331 toward the top side of the planar panel 35 and then extended downwardly through the third cable-retaining notch 351 to the bottom side of the planar panel 35 and then turned forwardly out of the cable bracket 3 to the power source. The second electrical wire 5 is inserted from the bottom side of the sloping panel 33 through the second cable-retaining notch 333 toward the top side of the planar panel 35 and then extended downwardly through the fourth cable-retaining notch 353 to the bottom side of the planar panel 35 and then turned forwardly out of the high tensile strength cable bracket 3 to the power source.

Thus, the first electrical cable 4 and the second electrical cable 5 are respectively secured to the first and third cable-retaining notches 331;351 of the high tensile strength cable bracket 3 and the second and fourth cable-retaining notches 333;353 of the high tensile strength cable bracket 3, avoiding a large angle curving of the electrical wires 4;5. When the electrical wires 4;5 are stretched by an external force, the high tensile strength cable bracket 3 transfer the stretching force to the lamp socket 2, avoiding disconnection of the electrical wires 4;5 from the electrodes E of the lamp socket 2.

Referring to FIGS. 3 and 4 again, the electrodes E are arranged in one side of the lamp socket 2. Preferably, the electrodes E are arranged in the lamp socket 2 in a parallel manner so that the respective ends of the first and second electrical wires 4;5 can be conveniently and straightly connected to the electrodes E in a parallel manner without bending.

Referring to FIG. 4 again, a first binding strap 6 is fastened to the high tensile strength cable bracket 3 to hold down the first electrical cable 4 in the first cable-retaining notch 331 of the high tensile strength cable bracket 3 and the second electrical cable 5 in the third cable-retaining notch 333.

Further, a second binding strap 7 is fastened to the high tensile strength cable bracket 3 to hold down the first electrical cable 4 in the second cable-retaining notch 351 of the high tensile strength cable bracket 3 and the second electrical cable 5 in the fourth cable-retaining notch 353.

Further, the high tensile strength cable bracket 3 is prepared by a thermal conductive plate member. When viewed from one side, the high tensile strength cable bracket 3 shows a substantially Z-shaped configuration for supporting the first electrical wire 4 and the second electrical wire 5 in a smoothly curved manner, avoiding internal conductor damage.

Figure 5:
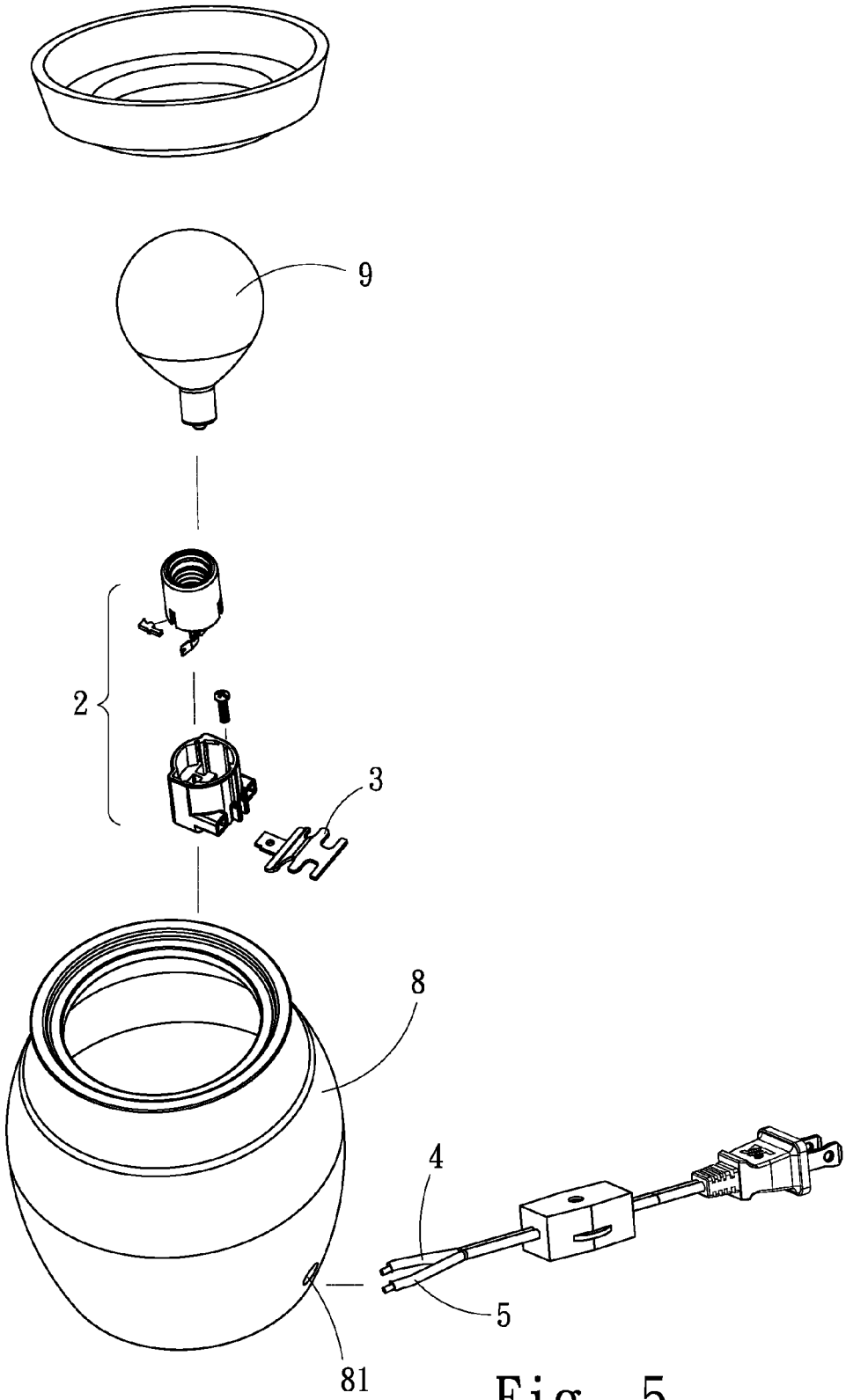
FIG. 5 is an exploded view of the lamp socket and cable bracket assembly in accordance with the present invention.
Figure 6:
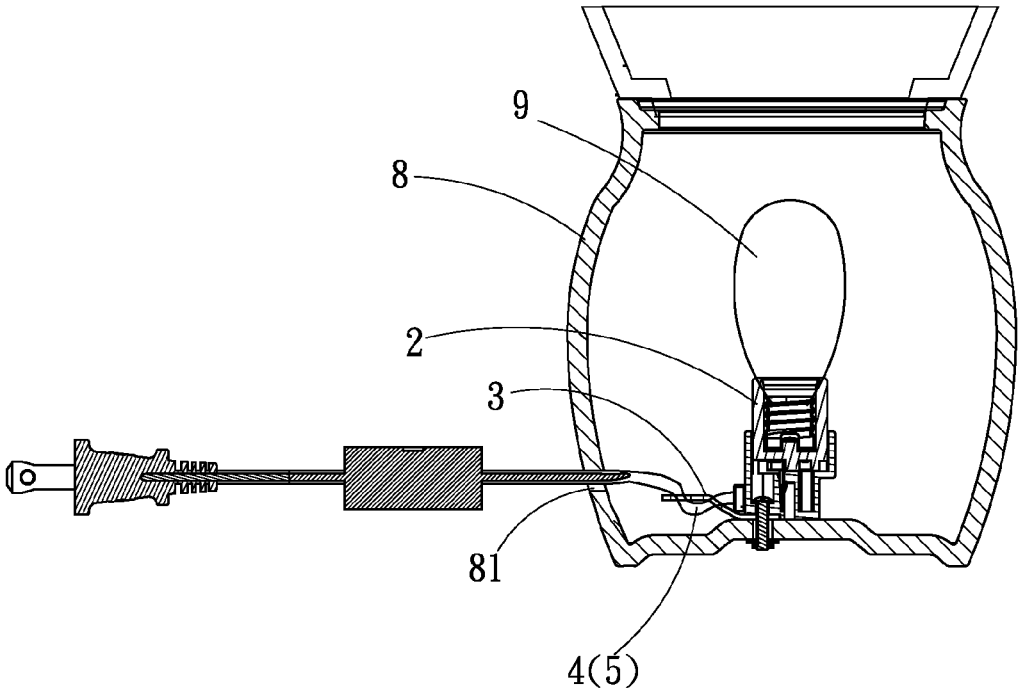
FIG. 6 is a sectional assembly view of FIG. 5.

Referring to FIGS. 5 and 6, the lamp socket 2 holds an aroma-diffusing lampshade 8 and a lamp bulb 9. The lamp bulb 9 is installed in the lamp socket 2 for giving off heat and light energy. The aroma-diffusing lampshade 8 is fastened to the lamp socket 2 around the lamp bulb 9, having a cable hole 81 for the passing of the first electrical wire 4 and the second electrical wire 5. Further, the aroma-diffusing lampshade 8 is prepared by a light transmissive material with high mechanical strength. Further, the aroma-diffusing lampshade 8 configured to hold an aromatic substance (such as essential oil, fragrant wax or the like) in a recessed top side thereof. When the lamp bulb 9 is electrically connected to give off light and heat energy, the aromatic substance in the recessed top side of the aroma-diffusing lampshade 8 will be heated into vapor. Thus, the invention is practical for home use as well as for SPA and beauty shop applications.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A lamp socket and cable bracket assembly, comprising:

a lamp socket; and a high tensile strength cable bracket for securing electrical wires, said high tensile strength cable bracket comprising a mounting lug fixedly connected to said lamp socket, a planar panel, a sloping panel obliquely connected between said mounting lug and said planar panel, a first cable-retaining notch and a second cable-retaining notch respectively and symmetrically located on two opposite lateral sides of said sloping panel, and a third cable-retaining notch and a fourth cable-retaining notch respectively and symmetrically located on two opposite lateral sides of said planar panel.

2. The lamp socket and cable bracket assembly as claimed in claim 1, wherein said first cable-retaining notch, said second cable-retaining notch respectively, said third cable-retaining notch and said fourth cable-retaining notch define a mouth, said mouth having a width relatively shorter than the internal width of the respective cable-retaining notch.

3. The lamp socket and cable bracket assembly as claimed in claim 2, further comprising a first electrical wire and a second electrical wire respectively electrically connected to said lamp socket for connection to an external power source, wherein said lamp socket comprises a plurality of electrodes arranged in one side thereof and respectively electrically connected with said first electrical wire and said second electrical wire; said first electrical wire being inserted from a bottom side of said sloping panel through said first cable-retaining notch toward a top side of said planar panel and then extended downwardly through said third cable-retaining notch to a bottom side of said planar panel and then turned forwardly out of said cable bracket to a power source, said second electrical wire being inserted from the bottom side of said sloping panel through said second cable-retaining notch toward the top side of said planar panel and then extended downwardly through said fourth cable-retaining notch to the bottom side of said planar panel and then turned forwardly out of said high tensile strength cable bracket to said power source.

4. The lamp socket and cable bracket assembly as claimed in claim 3, wherein said electrodes are installed in one side of said lamp socket and respectively electrically connected with said first electrical wire and said second electrical wire.

5. The lamp socket and cable bracket assembly as claimed in claim 4, wherein said electrodes are arranged in parallel and respectively electrically connected with said first electrical wire and said second electrical wire at right angles.

6. The lamp socket and cable bracket assembly as claimed in claim 5, further comprising a first binding strap fastened to said high tensile strength cable bracket to hold down said first electrical cable in said first cable-retaining notch of said high tensile strength cable bracket and said second electrical cable in said third cable-retaining notch.

7. The lamp socket and cable bracket assembly as claimed in claim 6, further comprising a second binding strap fastened to said high tensile strength cable bracket to hold down said first electrical cable in said second cable-retaining notch of said high tensile strength cable bracket and said second electrical cable in said fourth cable-retaining notch.

8. The lamp socket and cable bracket assembly as claimed in claim 1, wherein said high tensile strength cable bracket is a plate member.

9. The lamp socket and cable bracket assembly as claimed in claim 6, wherein said high tensile strength cable bracket is a plate member.

10. The lamp socket and cable bracket assembly as claimed in claim 7, wherein said high tensile strength cable bracket is a plate member.

11. The lamp socket and cable bracket assembly as claimed in claim 3, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

12. The lamp socket and cable bracket assembly as claimed in claim 4, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

13. The lamp socket and cable bracket assembly as claimed in claim 5, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

14. The lamp socket and cable bracket assembly as claimed in claim 6, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

15. The lamp socket and cable bracket assembly as claimed in claim 7, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

16. The lamp socket and cable bracket assembly as claimed in claim 8, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

17. The lamp socket and cable bracket assembly as claimed in claim 9, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

18. The lamp socket and cable bracket assembly as claimed in claim 10, further comprising a lamp bulb installed in said lamp socket and electrically connected to said electrodes for giving off light and heat energy, and an aroma-diffusion lampshade fastened to said lamp socket around said lamp bulb and configured to hold an aromatic substance in a recessed top side thereof for heating into vapor by the heat energy released by said lamp bulb, said aroma-diffusion lampshade comprising a cable hole for the passing of said first electrical wire and said second electrical wire.

* * * * *